United States Patent [19]

Gabriel

[11] Patent Number: 4,678,220

[45] Date of Patent: Jul. 7, 1987

[54] SHOVEL-LIKE COUPLING DEVICES WITH AUTOMATIC MATERIAL HANDLING FEATURES

[76] Inventor: Edwin Z. Gabriel, 91 Mt. Tabor Way, Ocean Grove, N.J. 07756

[21] Appl. No.: 830,211

[22] Filed: Feb. 14, 1986

[51] Int. Cl.[4] ..... B66C 1/38; B66C 3/10

[52] U.S. Cl. ..... 294/118; 294/68.23; 294/82.32; 294/110.1

[58] Field of Search ..... 294/66.1, 68.23, 68.3, 294/67.31, 81.51, 81.61, 82.27, 82.32, 106, 110.1, 111–113, 118, 902; 37/141 R, 183 R–187; 414/624–626

[56] References Cited

U.S. PATENT DOCUMENTS

| | | | |
|---|---|---|---|
| 64,169 | 4/1867 | Vandecar | 37/185 |
| 67,989 | 8/1867 | Kempton | 294/82.27 |
| 116,171 | 6/1871 | Ellithorpe | 37/185 |
| 681,518 | 8/1901 | Stevens | 294/112 |
| 891,598 | 6/1908 | Daly | 294/82.27 |
| 1,111,338 | 9/1914 | Watson | 294/118 X |
| 1,507,706 | 9/1924 | Miller et al. | 294/82.32 |
| 1,673,130 | 6/1928 | Walsh | 294/106 |
| 2,637,088 | 5/1953 | Foster | 294/118 X |
| 2,745,695 | 5/1956 | Peyer | 294/110.1 X |
| 2,920,917 | 1/1960 | Sheehan | 294/81.51 |
| 3,044,819 | 7/1962 | Pierre | 294/81.51 X |
| 3,410,593 | 11/1968 | Goodman | 294/68.23 |
| 3,497,021 | 2/1970 | Burrell | 294/68.23 X |
| 3,606,435 | 9/1971 | Weber | 37/183 R X |
| 4,109,952 | 8/1978 | Monzain | 294/118 X |

FOREIGN PATENT DOCUMENTS

| | | | |
|---|---|---|---|
| 10323 | of 1889 | United Kingdom | 294/82.27 |
| 928282 | 6/1963 | United Kingdom | 294/118 |

*Primary Examiner*—Johnny D. Cherry

[57] ABSTRACT

This tongslike device for automatically loading and unloading materials, such as dirt or soil, sand, gravel, vegetables, fruit and leaves and even containerized loads, comprises two elongated members, pivoted approximately midway with a pivot pin. The lower portions of the device are flared to enable it to hold more material or larger size containerized loads. Its weight distribution between its upper and lower portions is such that its lower portions will separate automatically at touch down. The ends of its lower portions or jaws may be serrated and sharpened to enable it to dig into the ground or other material for loading. In one version, the device is capable of scooping up a load cable automatically because of the shape of its jaws. The size and shape of its lower portions determine the material or size and shape of the load capable of being scooped up. Such automatic loading and unloading devices would make the cargo loading and unloading operations safer and speedier under hazardous environmental conditions.

4 Claims, 48 Drawing Figures

SHOVEL-LIKE COUPLING DEVICES WITH AUTOMATIC MATERIAL HANDLING FEATURES

BACKGROUND OF THE INVENTION

In the past when material such as dirt had to be loaded onto a truck, the shovel's pivoted lower portions were tied to a cable and the operator of the crane pulled a cable to enable the material held by the shovel to discharge its contents. This made extra work for the operator and slowed down his loading and unloading of materials onto a waiting truck.

With the proposed shovel-like device both the loading and unloading of materials are performed automatically, in so far as the grabbing of the materials and the discharge thereof are concerned. The operator of the crane only need lower the device onto the materials to be moved, then lift the device with the materials, swivel or rotate them onto a waiting truck and then lower the device into the waiting truck, where the materials would be discharged without the need for any electrical signals or the pulling of any cables.

SUMMARY OF THE INVENTION

The present invention describes a novel automatic shovel unloading, with few parts and no electrical parts requiring electrical signals or cords for mechanically causing the shovel to unload its cargo, were it dirt, snow, rocks, minerals or garbage. For trash collection, no ground personnel need be present. The strut or boom for supporting the shovel assembly may be mounted on top of the trash truck. The motions of the strut could be made by the truck driver or by the worker assisting the driver, for, say, loading the trash onto the truck.

In one technique described here, a tong-like coupling device will be decoupled automatically to unload its cargo, whatever it may be, as soon as the suspended shovel device makes contact with a stationary object, such as the platform of a trash truck.

Because under loaded conditions of the shovel, the tension on the hoist cables tends to keep the device's two lower sharply curved portions together in meshed contact, the cargo is prevented from being unloaded. The ends of the lower portions are somewhat sharpened in order to pick up cargo more easily.

Since this technique involves just two approximately flat elongated members pivoted near their midsection and having lower sharply curved portions, the device is uncomplicated, inexpensive, reliable and essentially maintenance free.

In this technique, unloading the cargo is impossible with the hoist cables in tension as a result of load suspension, not until the shovel device rests on a stationary object. When the device does come to rest and the tension on the hoist cable is reduced by virtue of its becoming slack, the curved bottom portions will automatically separate, allowing the cargo to be released, by reason of the resultant torques of the lower curved portions. After unloading its cargo, the lower curved portions will come together as soon as tension is restored in the hoist cable. Now the shovel device is free to be used to obtain another load. Placing the device on top of another pile of dirt, for example, causes the hoist cable to slacken, and the lower portions separate to grab another load of dirt with its sharp ends. These sharp ends, whether they be curved or straight, may have teeth, should the load be of such a material or substance that could be grabbed more easily with teeth than with plain straight or curved ends.

BRIEF DESCRIPTION OF DRAWINGS

For the purpose of illustrating the invention, the following drawings show forms which are presently preferred. It is to be understood, however, that this invention is not necessarily limited to the precise arrangement, instrumentalities and field of utility as therein demonstrated.

DESCRIPTION OF THE PREFERRED EMBODIMENT

Figure 2:
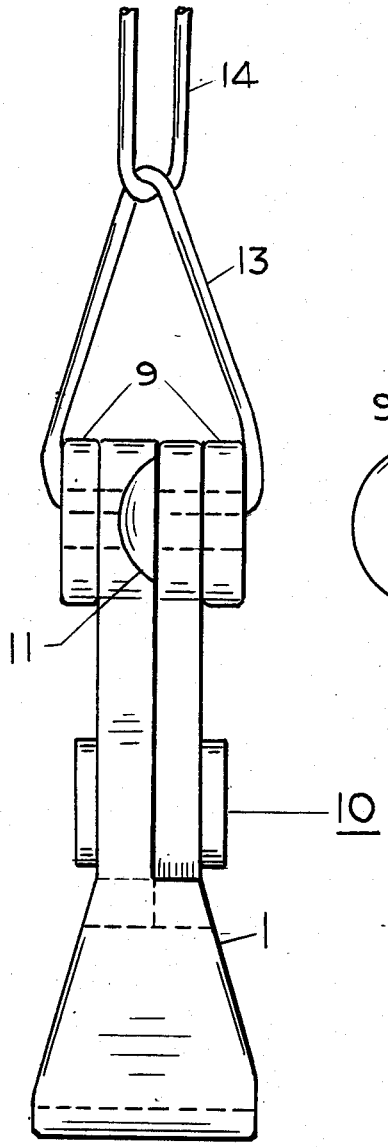
FIG. 2 is a side view thereof.
Figure 1:
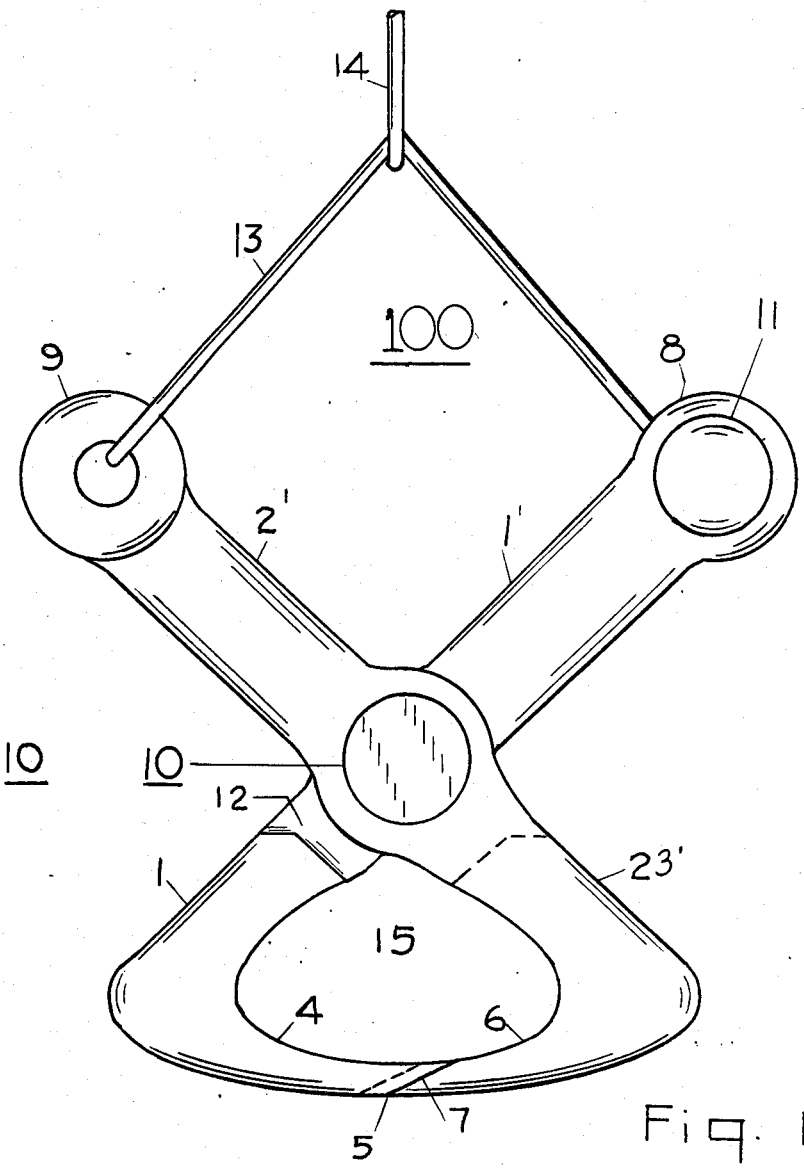
FIG. 1 is a front view of an assembled automatic unloading shovel-like device, showing the location of the hoist cables attached to the holes in the upper portions of the device. The flat elongated members with their lower portions fanned out have ends which come into contact and mesh for the purpose of scooping up and holding material in the lower cavity portion, for the purpose of transporting such materials.
Figure 3:
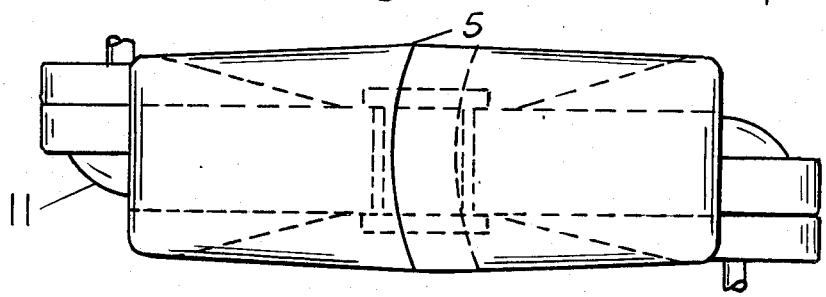
FIG. 3 is a bottom view thereof, showing the expanded width of the sharply curved lower portions and the curved line of contact between the two.

An embodiment of a shovel-like device is portrayed in the assembly drawings of FIGS. 1, 2 and 3. Hoist cables 13 and 14 are shown to indicate their locations, although the actual fittings, rings or wire ropes used for attachments to the device would be decided by the user and are not necessarily considered part of this invention, provided forces F exist, FIG. 1, when a load is being carried.

The device shown in FIG. 1 has its lower portions engaged in meshed contact and is so designed in its weight distrbution as to uncouple when the device with suspended materials makes contact with a loading surface or platform, causing the tension on hoist cable 13 to slacken significantly. When tension on cable 13 slackens, lower portions 4 and 6 of the device, FIG. 1, will spread apart automatically, due to weights 9 on upper portions 1' and 2'. The materials held by lower curved portions 1 and 2 will automatically discharge, due to gravity. Friction at pivot 10 is assumed to be negligible.

Figure 4:
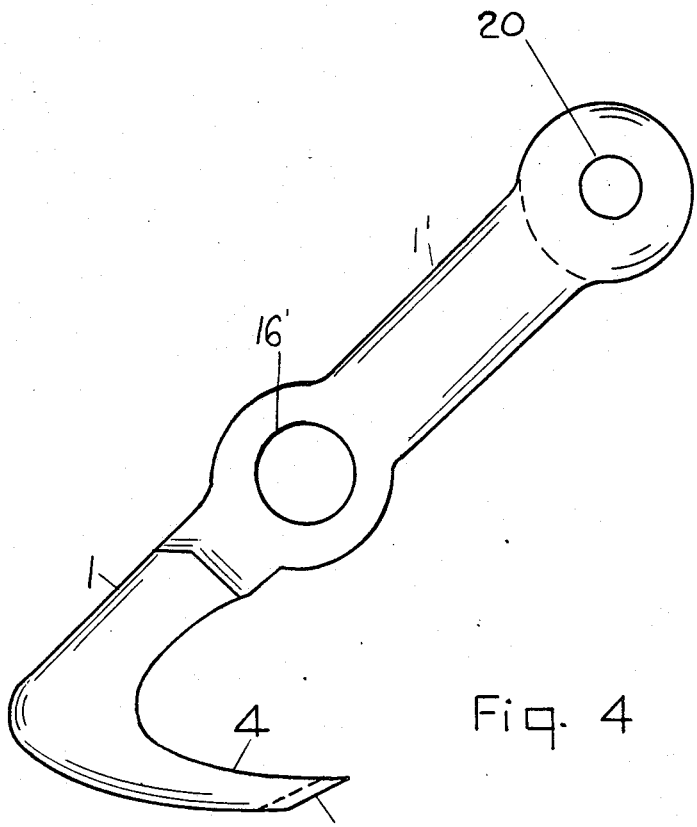
FIG. 4 is a front view of one-half of the shovel-like device of FIG. 1, showing the end of the curved portion, including the shape of the area of contact with the other end of the second portion.
Figure 6:
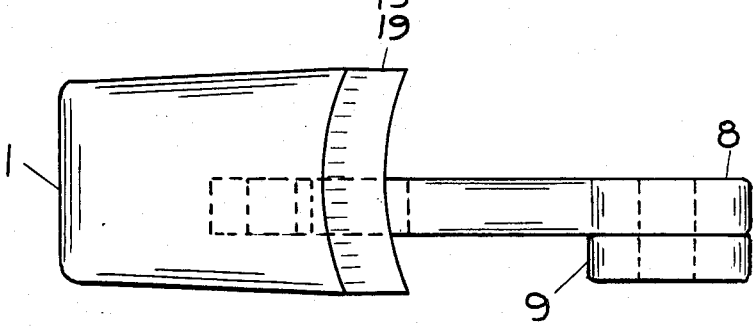
FIG. 6 is a bottom view thereof.

The device's parts comprise sickle-shaped half 1 with a sharply curved lower portion 4 having a sharpened curved end 19, FIGS. 4 and 6. The other half of device 100 has optional toothed lower end (not shown here) to mesh with end 19, FIG. 4. Numeral 7, FIG. 1, points to the contact area between the two lower ends.

Both halves 1 and 2 of the device have two thicknesses, as upper portions 1' and 2' are much thinner than the lower curved portions. The change in thickness occurs at location 12, FIG. 1. Below location 12, lower portions 1 and 2 flare outwardly like skirts, in order to provide more volume in space 15 for storage and holding of materials.

It should be noted that while device 100 is carrying a load in suspension, lower portions cannot separate, for the reasons below:

1. The horizontal components of tension in cable 13;
2. Ends of lower portions 1 and 2 making overlapping contact with each other at 5 and 7, FIG. 1.

When the bottom surface of device 100 makes contact with another load of material or a stationary object, then portions 4 and 6, FIG. 1, will separate, because of significantly reduced tension in cable 13, allowing the material in cavity 15 to discharge. Ends of lower portions 1 and 2 will not come together again until tension again occurs in cable 13, FIG. 1. This would happen when device 100 is lifted by means of cable 14.

Figure 9:
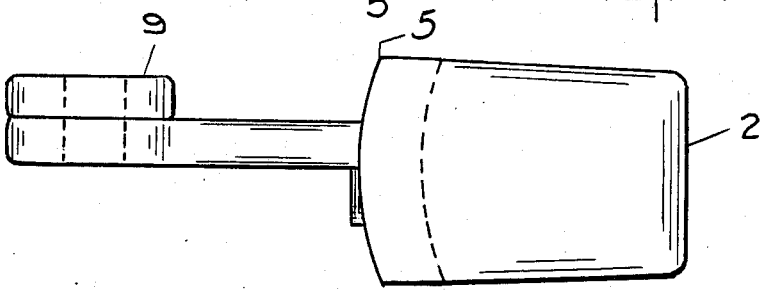
FIG. 9 is a bottom view thereof.

In order for the bottom portions 4 and 6 to aid and share in any lateral stresses that may occur in pivot pin 10, the end of portion 4 is slightly concave as shown in FIG. 6 and the end of portion 6 is slightly convex, as shown in FIG. 9. Thus lower portions 4 and 6 assist in sharing stresses imposed on pin 10, due to any back-and-forth swaying motions of device 100, when suspending a load of material.

Figure 5:
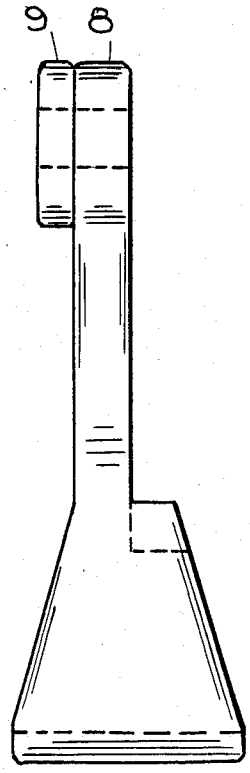
FIG. 5 is a side view thereof.
Figure 8:
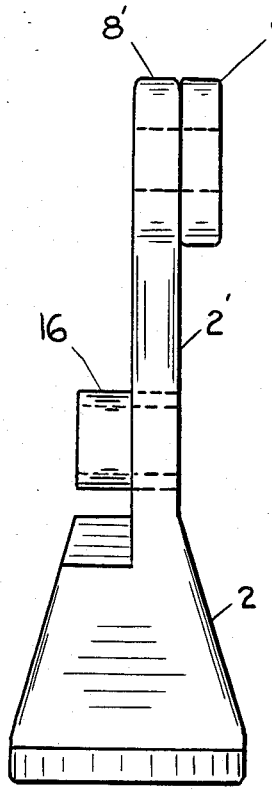
FIG. 8 is a side view thereof.
Figure 7:
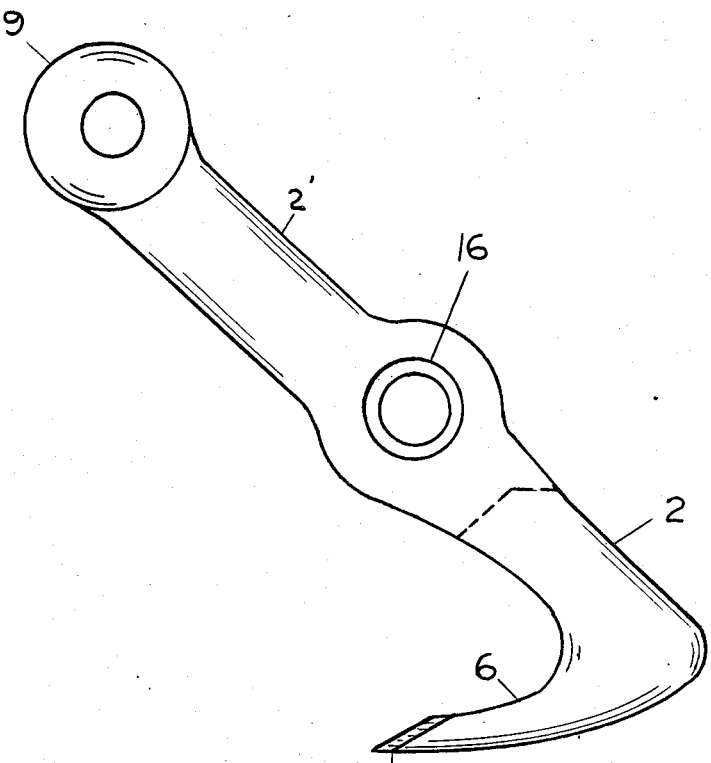
FIG. 7 is a front view of the other half of the same shovel-like device, showing the other end of the curved portion, including its shape.

FIGS. 4, 5 and 6 show the front, side and bottom views of member 1, FIG. 1, respectively, while FIGS. 7, 8 and 9 show the front side and bottom views of member 2, FIG. 1, respectively.

Figure 2A:
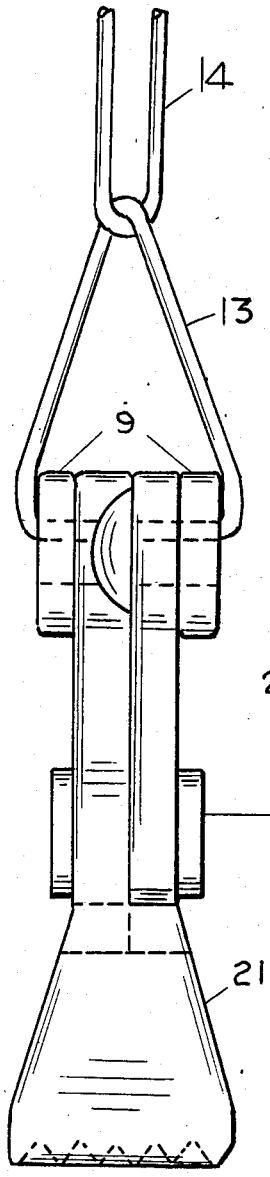
FIG. 2A is a side view thereof.
Figure 1A:
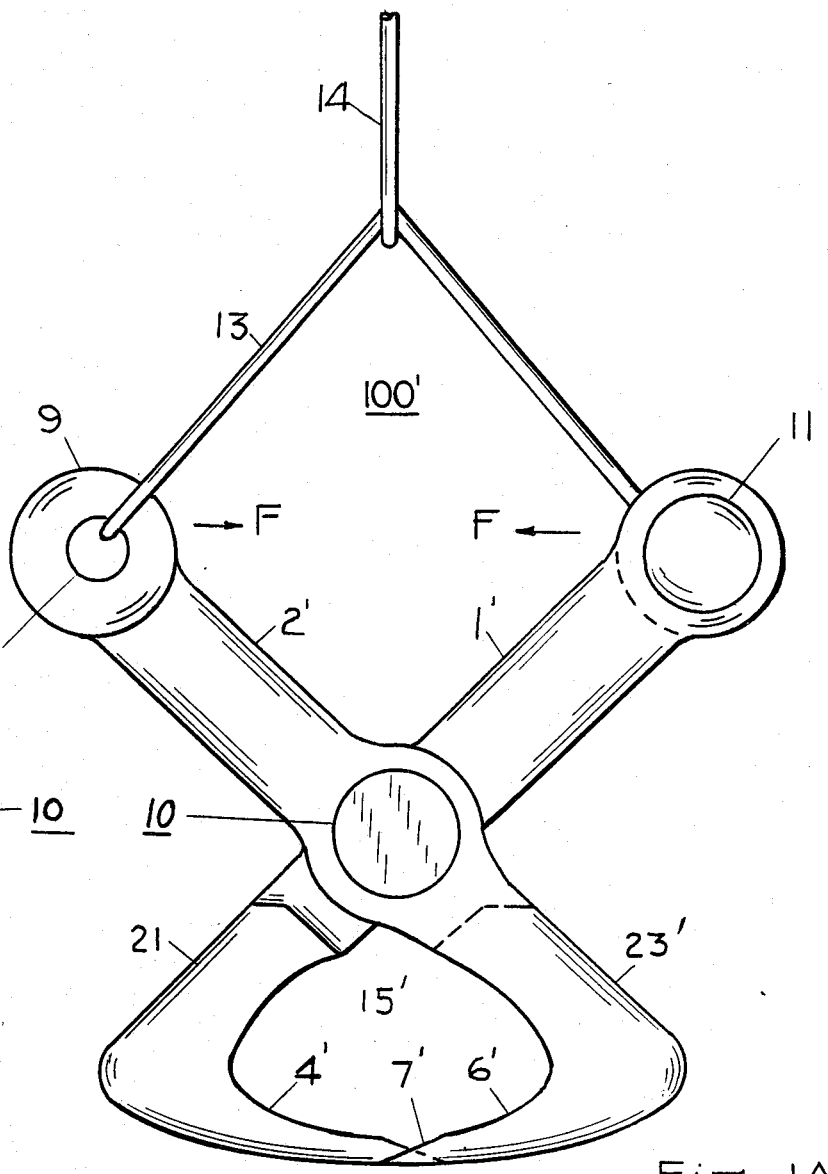
FIG. 1A is a front view of the assembled shovel-like device, identical to FIG. 1, except for the serrated lower ends which mesh and mate together.
Figure 3A:
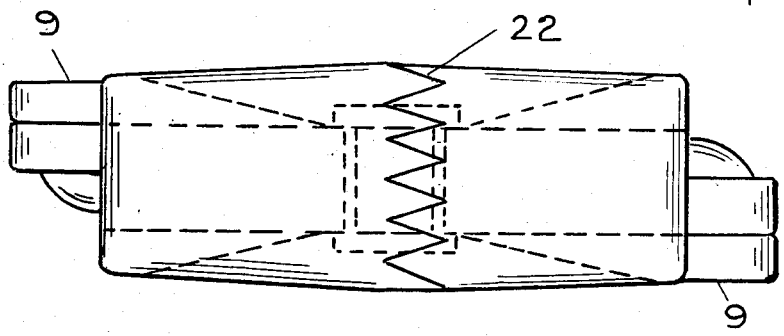
FIG. 3A is a bottom view thereof.

To make it easier for device 100 to gather a load from a pile of rocks, coal, dirt or other material, edge 19, FIG. 4, may be serrated and sharpened to aid in the scooping process. FIG. 1A shows the front view of the assembled shovel-like device with its lower portion ends serrated and triangular shaped. Inside surface of cavity 15 could be bowl-shaped and recessed as in FIG. 10. The serrations 22 are shown in FIGS. 2A and 3A. Serrated ends of portions 4' and 6', FIG. 1A, mesh together, preventing loose matter from falling through. Numeral 7' points to the contact area. Since these serrated ends mesh, there is no need to curve the ends in bottom view, FIG. 3A, as in FIG. 3, for sharing the lateral stresses imposed on pin 10. The lower portions of device 100', FIGS. 1A, 4A and 7A, are identified by numerals 21 and 23', as shown.

Figure 5A:
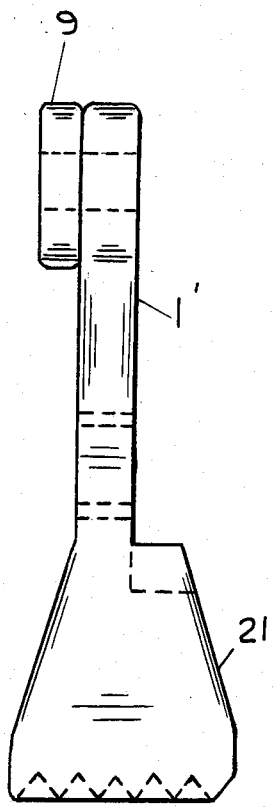
FIG. 5A is a side view thereof, showing the serrated end.
Figure 4A:
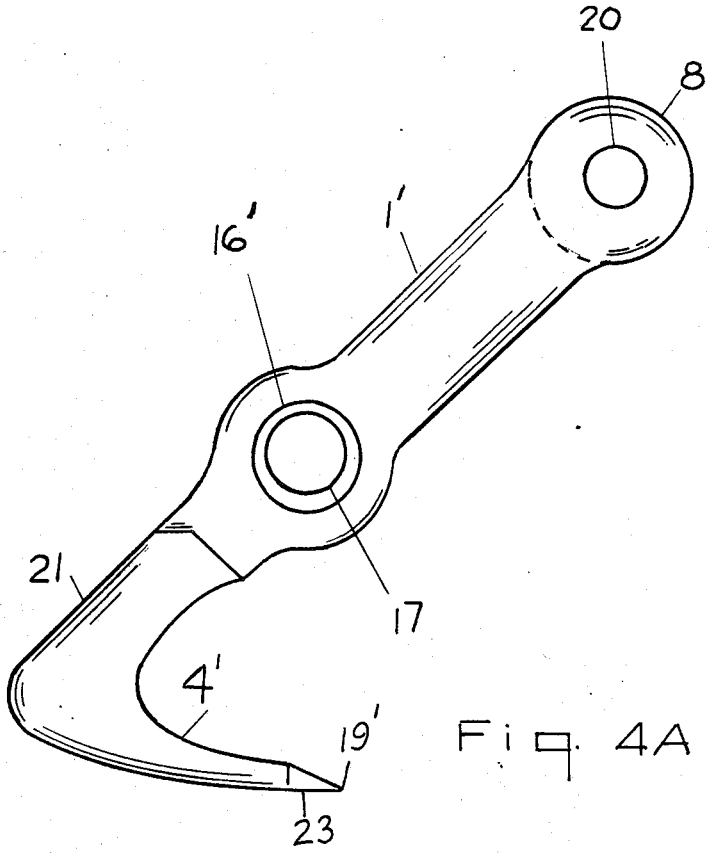
FIG. 4A is a front view of one-half of the shovel-like device of FIG. 1A, showing the serrated end of the lower curved portion.
Figure 6A:
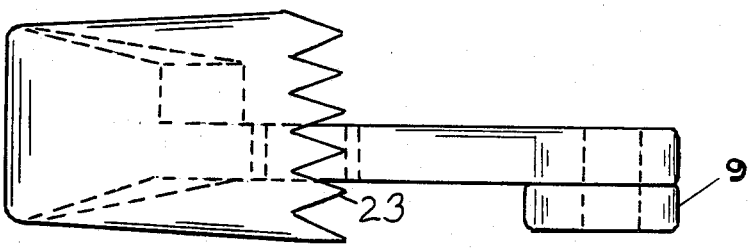
FIG. 6A is a bottom view thereof.

FIGS. 4A, 5A and 6A show one-half 1 of the device shown in FIG. 1A. Note the serrations 23 in end 19' of the lower portion 4', which are sharpened for ease in digging materials from the ground, if required. To reduce friction in members 1 and 2, when they rotate in opposite directions to unload material, bushing 16 is provided for pin 10, FIGS. 4A and 7A, which could be of hard bronze material. The device itself in its unassembled form could be nickel or cadmium plated to avoid any corrosion when in use.

Figure 8A:
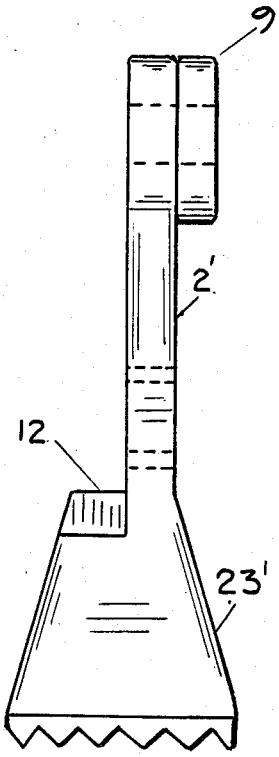
FIG. 8A is a side view thereof, showing the other end of the lower curved portion of FIG. 1A.
Figure 7A:
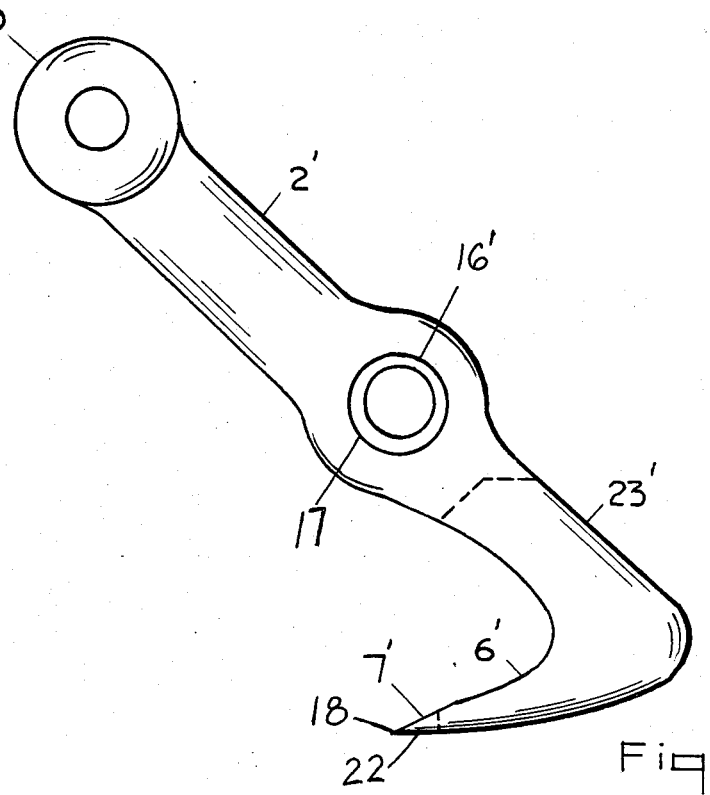
FIG. 7A is a front view of the other half of the same shovel-like device of FIG. 1A, showing the other serrated end of the curved portion.
Figure 9A:
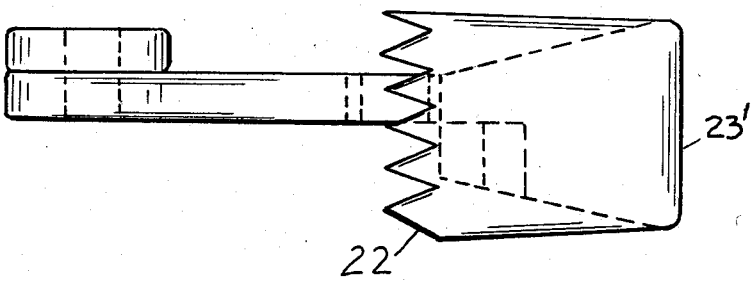
FIG. 9A is a bottom view thereof.

FIGS. 7A, 8A and 9A show the other other half of device 100'. Note again serrations 22 in end 18 of lower portion 6', which may be sharpened for ease in digging materials from the ground. Bushing 16, FIG. 7A, is provided to reduce friction when member 2 rotates about pin 10.

It should be added that lower portions 4 and 6 of the device shown in FIG. 1 and portions 4' and 6' shown in FIG. 1A have overlapping ends. Without having a crevice, as in dovetailing, device 100 could scoop up materials without the possibility of a crevice becoming clogged and interfering with the proper mating of ends of portions 4 and 6.

Dashed lines 12 inside lower portions 1 and 2, FIG. 1, show how cavity 15 may be enlarged to carry cylindrically-shaped cargo. Enlarging cavity 15 would not necessarily weaken lower portions 1 and 2 of device 100, since portions 4 and 6 are even narrower in thickness.

Figure 18:
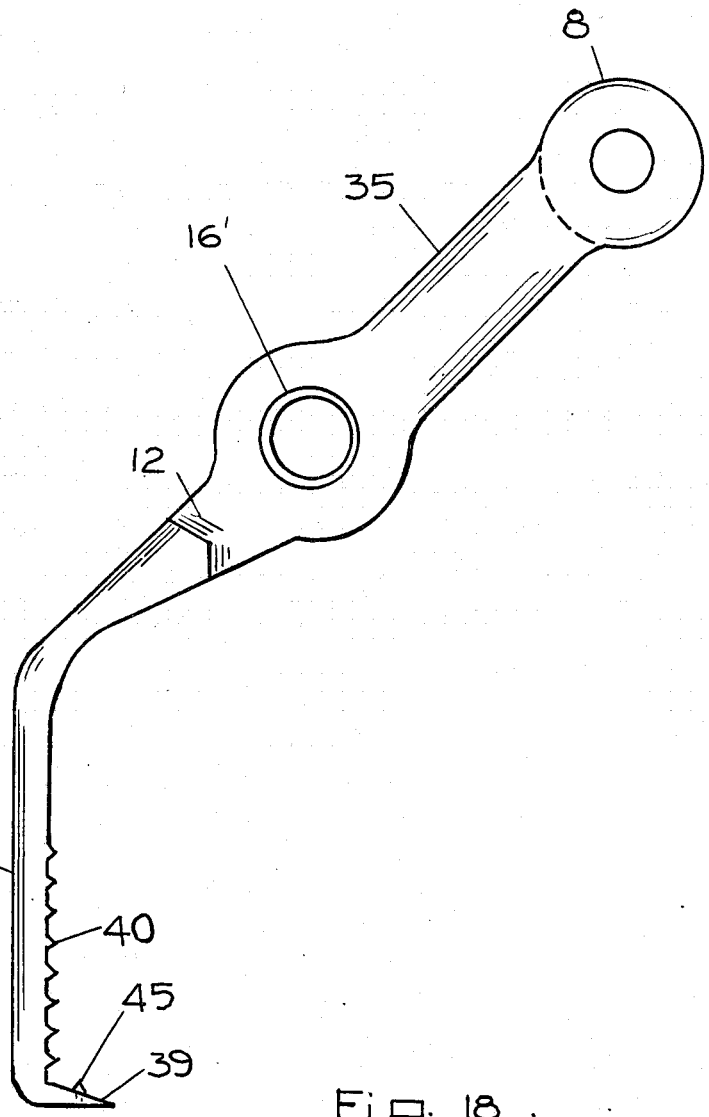
FIG. 18 is a front view thereof, showing the bushing.
Figure 21:
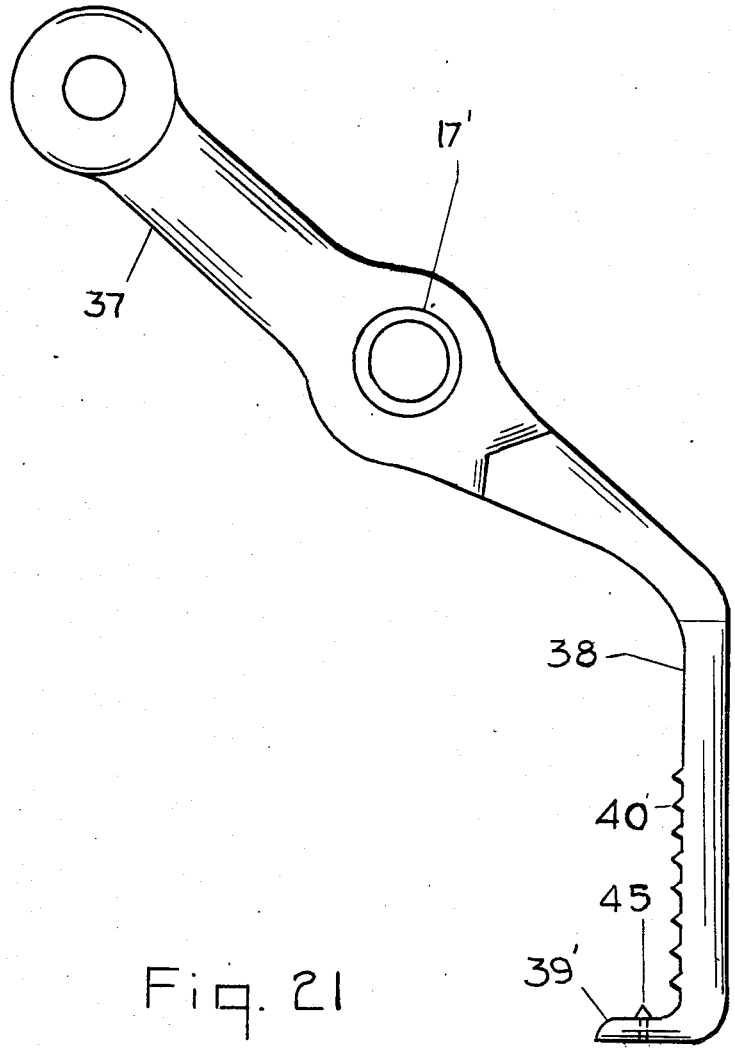
FIG. 21 is a front view thereof, showing the bushing.
Figure 25:
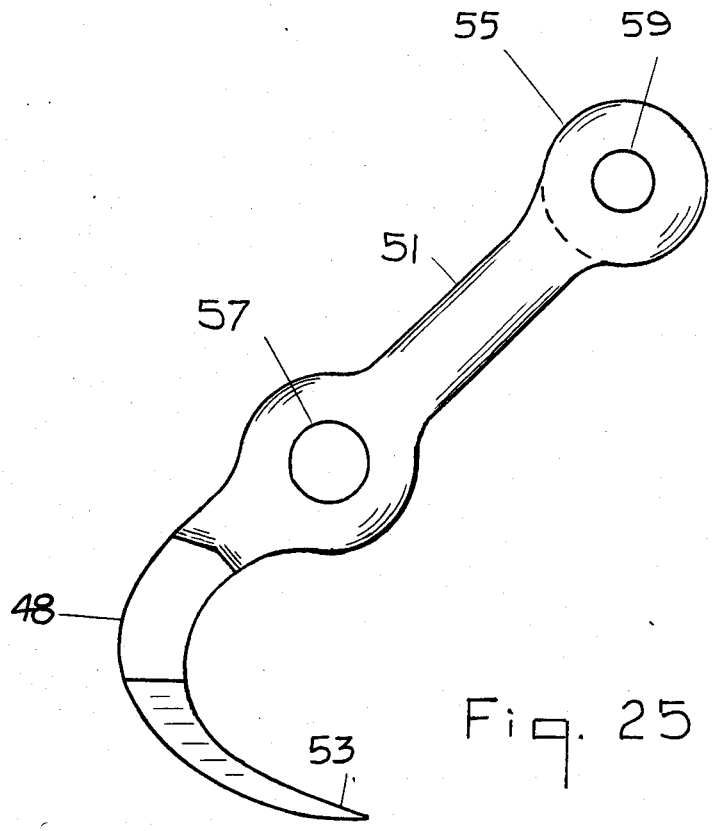
FIG. 25 is a front detailed view of one-half of the cable-scooping device in FIG. 22.
Figure 27:
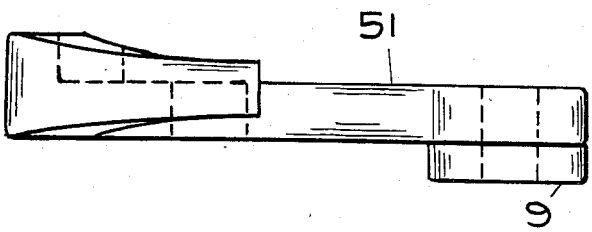
FIG. 27 is a bottom view thereof.
Figure 28:
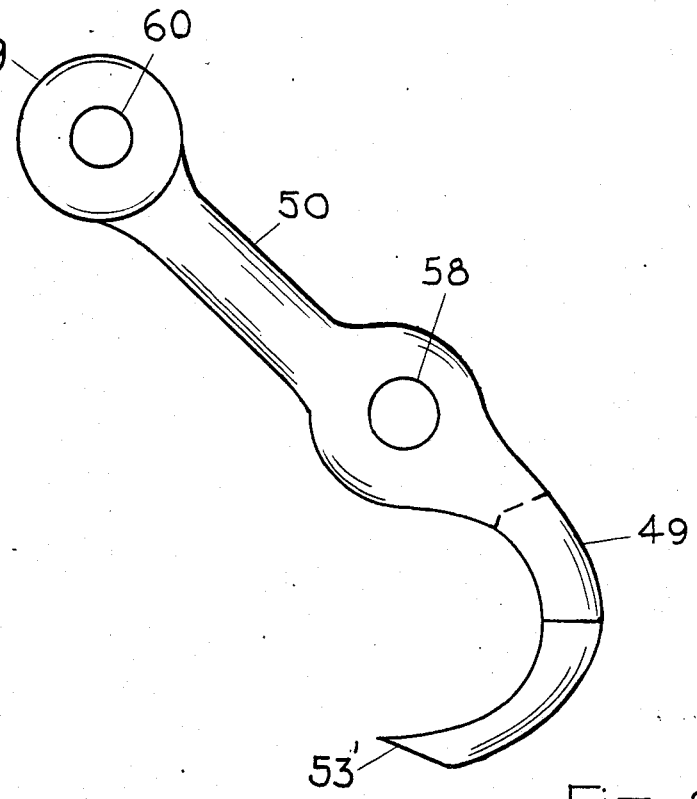
FIG. 28 is a front detailed view of the other half of the same cable-scooping device.
Figure 30:
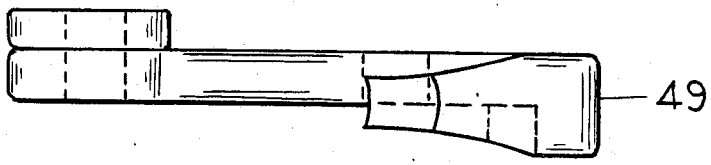
FIG. 30 is a bottom view thereof.

Bushing 16, FIG. 7, may consist of a single piece, extending into both central holes 16' of halves 1 and 2, or it may comprise two pieces, as in FIGS. 18 and 21 of a similar device, each the thickness or width of a single half of device 100. The former, a single length of bushing, would be preferred. In FIGS. 25 and 28 of a similar device 60, the bushing has been omitted completely, as an alternate construction.

DESCRIPTION OF ANOTHER EMBODIMENT No. 2

Figure 11:
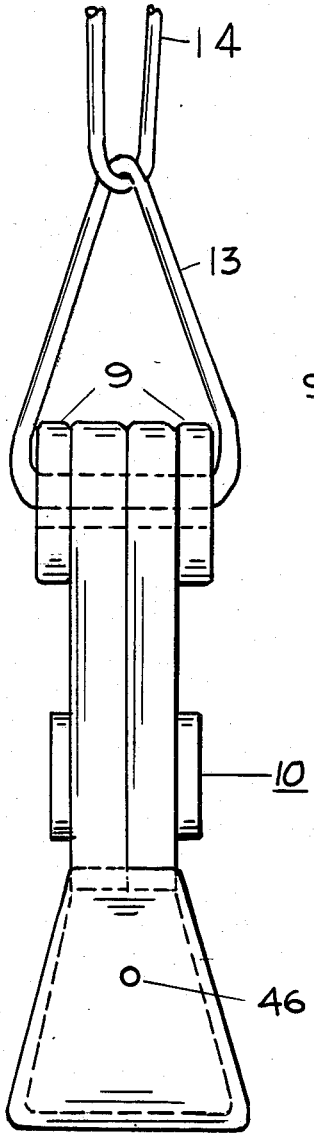
FIG. 11 is a side view thereof.
Figure 10:
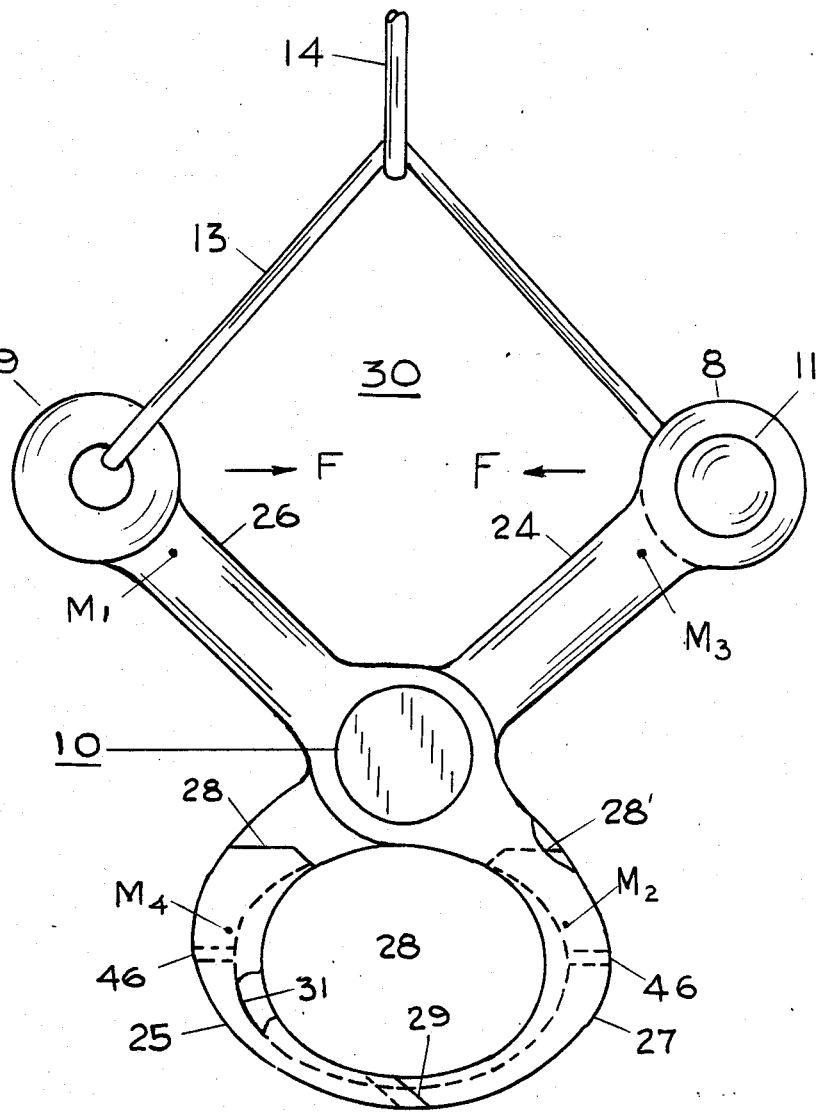
FIG. 10 is a front view of a shovel-like device with an elliptical cavity for holding either cylindrical cargo or loose matter.
Figure 12:
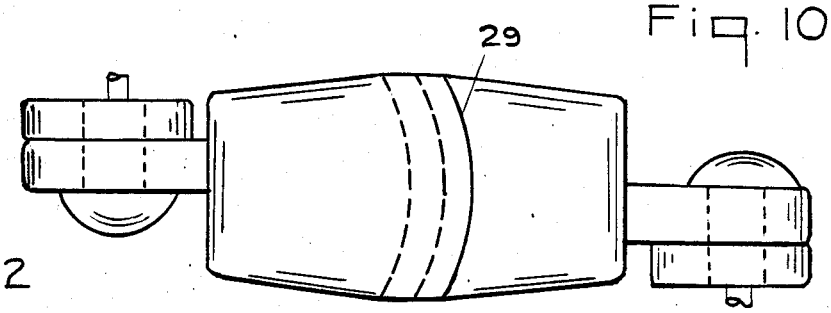
FIG. 12 is a bottom view thereof.

An embodiment of a shovel-like device 30 is portrayed in the assembly drawings of FIGS. 10, 11 and 12. Hoist cables 13 and 14 are shown to indicate their locations, although again the actual fittings used for attachments to the device 30 would be decided by the user and are not considered part of this invention, provided forces F exist, FIG. 10, when materials are being suspended.

Device 30 shown in FIG. 10 has its lower portions 25 and 27 engaged, since the device is in suspension, but without carrying anything. Lower portions 25 and 27 are recessed or bowl-shaped in order to be cable of holding and carrying materials like sand, dirt and gravel without spilling any appreciable amount of the material. The side view, FIG. 11, shows in dashed lines the shape of the cavity or recess 31. Upper portions 24 and 26 include heavy metal rings 9 attached to each end, as shown, to provide the torque needed for lower portions 25 and 27 to separate when forces F, FIG. 10, become negligible and the materials held are to be dumped onto a selected site. FIGS. 11 and 12 show device 30's side and bottom views, respectively. Bottom view, FIG. 12, shows curved line 29, denoting that the intersection or contact between the lower portions is shaped to share back-and-forth motion stresses with pivot pin 10, when suspended under wind gust conditions.

Figure 10A:
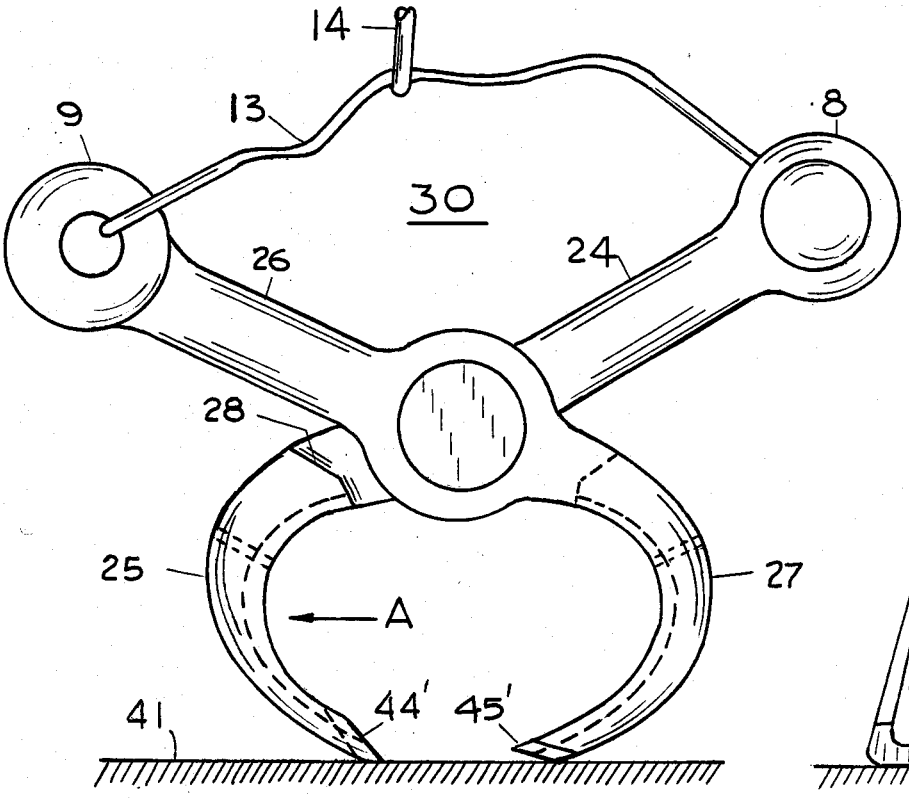
FIG. 10A is a front view of the shovel-like device with its lower portions separated for discharging of either cargo or loose matter.
Figure 10B:
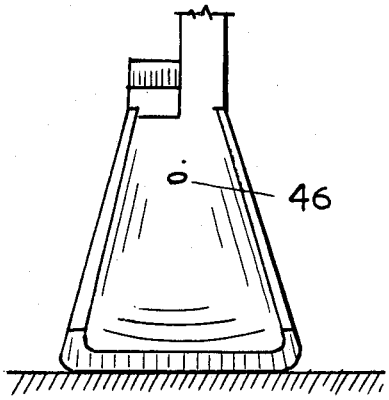
FIG. 10B is an inside view of one of the lower portions of device shown in FIG. 10A.

Halves 24 and 26 of device 30, FIG. 10, have two thicknesses along their length, as one observes from examination of the drawings. The lower portions, starting at lines 28 and 28' are much thicker as can be seem from Bottom View, FIG. 12. This is necessary, in order to enable device 30 to scoop up a fairly-sized amount of material , when lowered onto the material. The ends of lower portions 25 and 27 are sharp, as shown in FIG. 10A, in order to dig into and scoop up as much material as possible. $M_1$, $M_2$, $M_3$, $M_4$ are assumed centers of mass of upper and lower portions of the device, their locations in lower portions dependent upon material in cavity 28.

Device 30 is so designed in its weight distribution, with weights added to its upper portions, that the device with suspended materials will uncouple and lower portions 25 and 27 will separate from one another as shown in FIG. 10A, as soon as its bottom portion makes contact with a selected unloading surface or site. Its bottom ends 44' and 45' will separate as shown in FIG. 10A allowing the materials being transported to be discharged onto the selected site. If all the contents of lower portions 25 and 27 are not discharged the first time, device 30 may be lifted and dropped onto the site the second time, adjacent to the place that it first was dropped. This way some of the old material will not be scooped up again.

Another application for this device is to pick up short logs automatically and transport such to another site. When logs are to be picked up, holes 46, one on each lower portion of device 30, will have sharp-pointed pins inserted to pierce and hold a log in place, so that it will not be allowed to fall out of cavity 28, FIG. 10, while being transported. For longer logs, two devices, in tandem, but separated from one another in accordance with the length of the log, could be used, to prevent the log from tipping downward when off balance, or because of weather conditions, such as wind gusts.

It should be explained that while device 30 is carrying a load in suspension, the device is designed so that lower portions 25 and 27 cannot separate, for the following reasons:

1. The horizontal components of tension F in cable 13, due to the weight of both the device itself and the load being suspended.
2. Ends 44' and 45' of lower portions 25 and 27 making overlapping contact with each other along line 29, FIGS. 10 and 12.

When it is necessary to discharge the load, the following conditions should exist:

1. Hoist cable 13 must be slack.
2. The resultant torque of upper portions 24 and 26 to cause upper and lower portions of device 30 to want to separate should be greater than the resultant torque of lower portions 25 and 27, including the weight of the suspended load, to want to keep lower ends 44' and 45' in contact with each other.

DESCRIPTION OF ANOTHER EMBODIMENT No. 3

Figure 14:
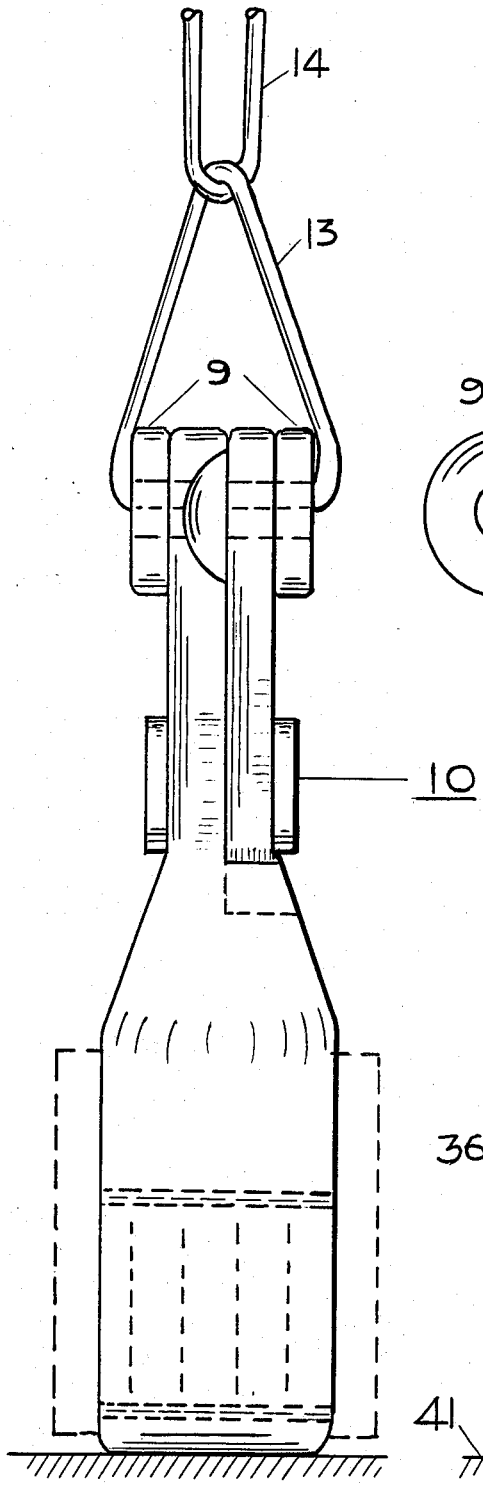
FIG. 14 is a side view thereof.
Figure 13:
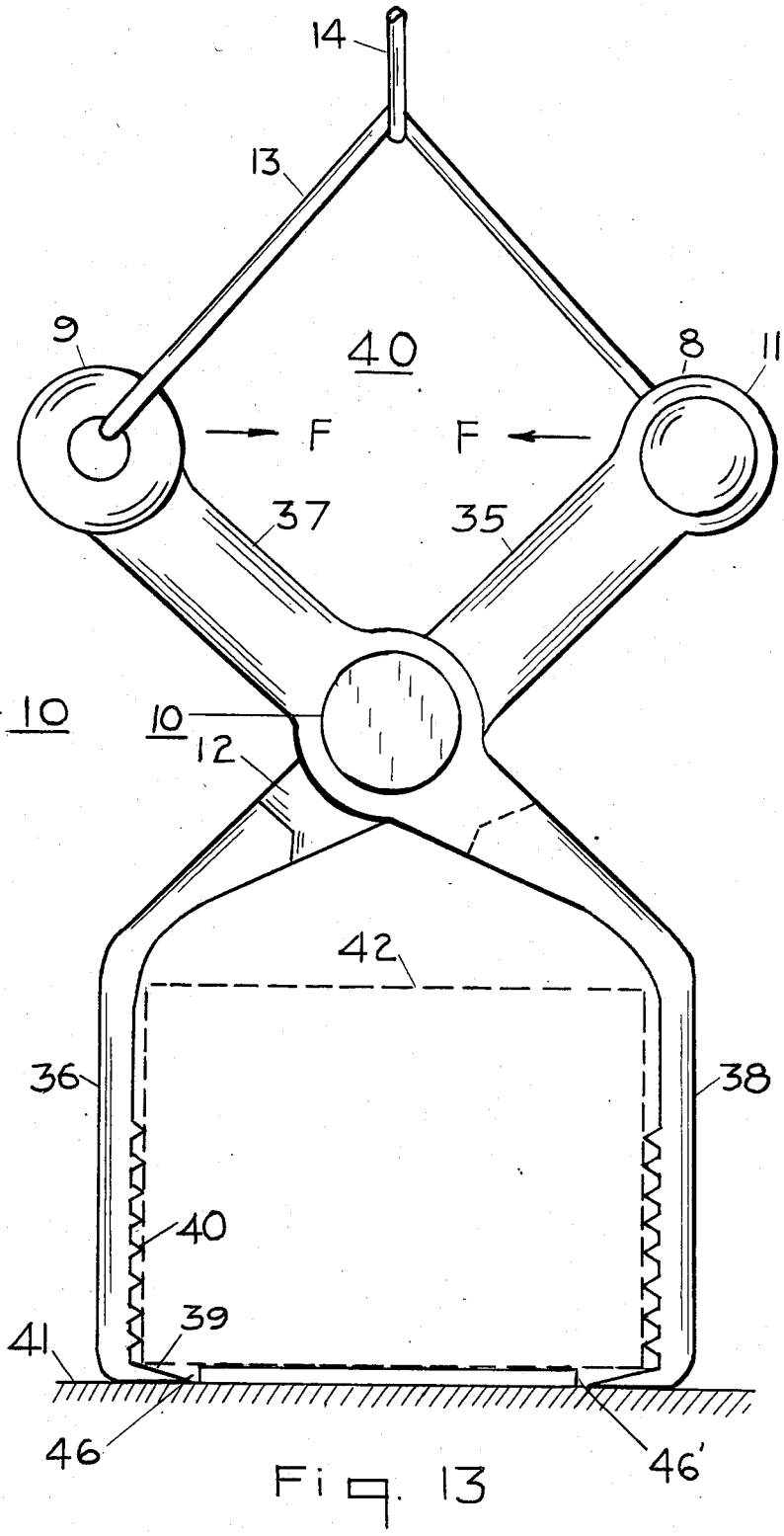
FIG. 13 is a front view of a containerized cargo loading and unloading device with an approximate rectangular cavity.
Figure 15:
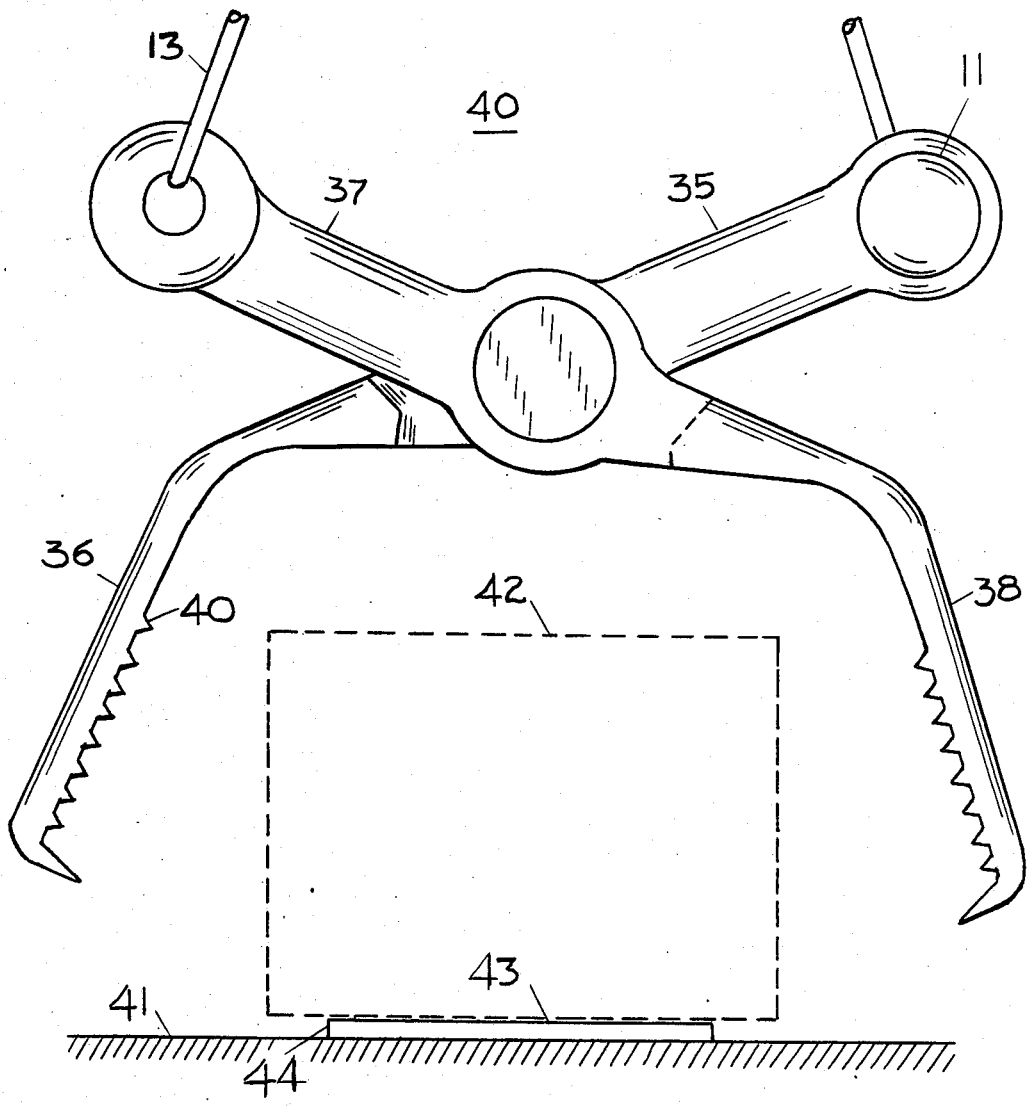
FIG. 15 is a front view of the device shown in FIG. 13 with its lower portions separated in the unloading position.

An embodiment of a load-lifting device 40 is portrayed in the assembly drawings of FIGS. 13 and 14. Hoist cables 13 and 14 are shown to indicate their locations, although the actual fittings, rings or wire ropes used for attachments to the device would be decided by the user and are not necessarily considered a part of this invention, provided forces F exist, FIG. 13, when cargo is being suspended.

The device shown in FIG. 13 has its lower portions 36 and 38 engaged onto a rectangular container which is supported by a pallet 44 at its base; and pallet 44 is supported by platform 41. Either pallet 44 or a recess along the bottom side edges of container 42 is necessary if lower portion protrusions 39 and 39' are to move apart automatically when container 42 is lowered and makes contact with a surface below, reducing the tensions in hoist cables 13 and 14.

Device 40 also can load a container automatically without the presence of anyone at the loading site because of protrusions 39 and 39', FIG. 13.

When the load is raised by a hoist cable attached to hoisting equipment on a crane, derrick or helicopter, and moved or transported to a platform at a desired site, it is lowered onto the platform. In the drawings it is assumed that the platform has pallet 44, as shown in FIG. 13. It would be preferred that the two opposing parallel bottom edges of container 42 have recesses to accommodate protrusions 39 and 39', FIG. 13. Consequently, when container 42 makes contact with surface 43, lower portions 36 and 38 will separate automatically, when the tensions on hoist cables 13 and 14 are significantly reduced, thus allowing container 42 to be unloaded or discharged. It should be mentioned that the reason lower portions 36 and 38 automatically separate is because the resultant torques of upper portions 35 and 37 exceed the resultant torques of lower portions 36 and 38.

FIG. 14 is a side view of FIG. 13 showing the width and and shape of lower portions 36, including a side view of the containerized load 42 in dashed lines, as the load itself is not considered a part of the invention.

Figure 16:
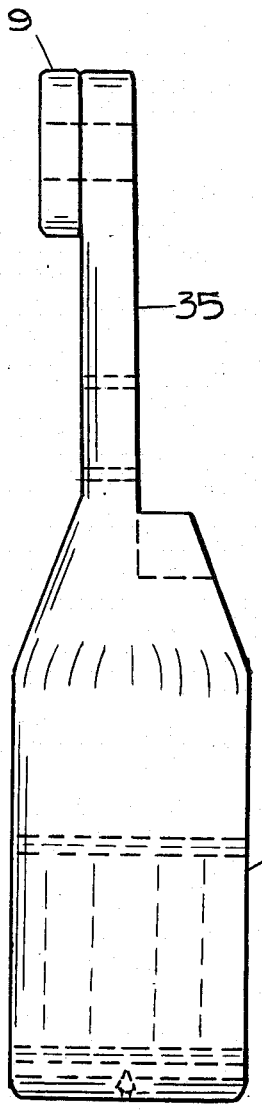
FIG. 16 is a side view of one of the halves of the device.
Figure 17:
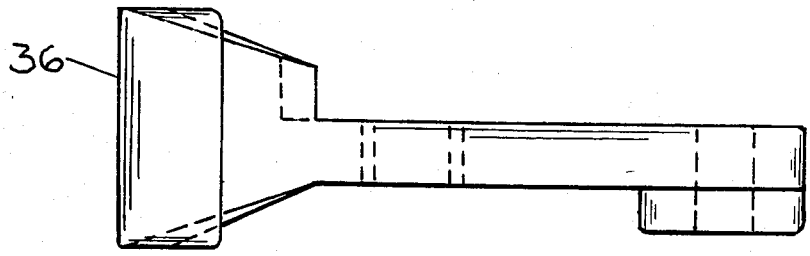
FIG. 17 is a bottom view thereof.
Figure 19:
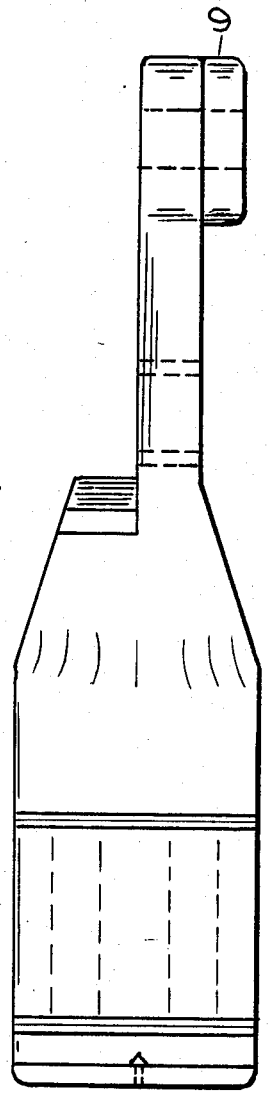
FIG. 19 is a side view of the other half of device in FIG. 13.
Figure 20:
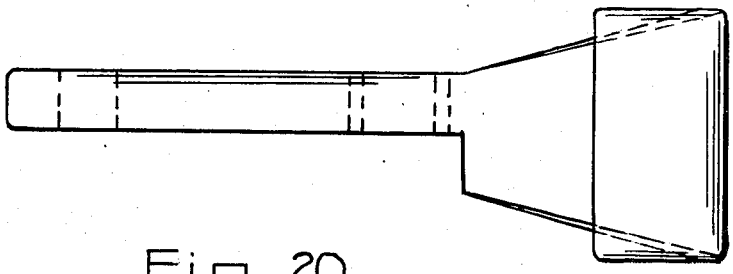
FIG. 20 is a bottom view thereof.

Detailed views of one-half of device 40 are shown in FIGS. 16, 17 and 18, the side, bottom and front views, respectively. Detailed views of the other half of device 40 are shown in FIGS. 19, 20 and 21, the side, bottom and front views, respectively.

Several pointed projections 45 may be added along protrusions 39 and 39', FIGS. 13, 18 and 21, in order to assist in holding load 42 in place while it is being transported. Since space 46 and 46' exists under protrusions 39 and 39', the projections 45 and 45' will clear load 42, when bottoms of lower portions 36 and 38 rest on platform 41, and device 40 will not interfere with the automatic unloading process. Projections 45 and 45' would only be desirable on special occasions, such as for a heavy load, slightly off center. Projections 45 and 45' may be removed by unscrewing each one from a threaded hole, since they would not be required for transporting light, balanced loads. After container 42 is unloaded, projections 45 and 45' will automatically withdraw from the container's bottom surface because of device 40's weight. Then container 42 may be either pushed aside or device 40 may be swung away from container 42, before being hoisted, to avoid container from being snatched or scooped up a second time.

DESCRIPTION OF STILL ANOTHER EMBODIMENT

No. 4

Figure 23:
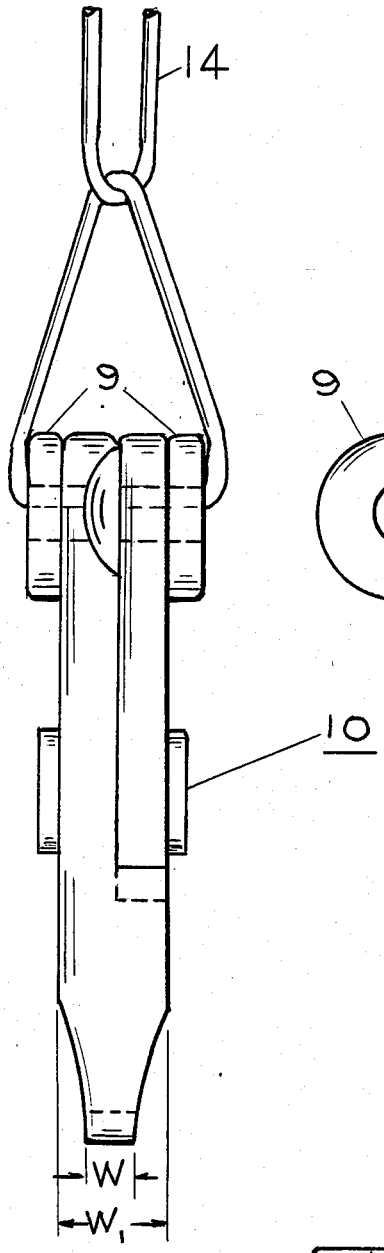
FIG. 23 is a side view thereof, showing the tapered shape of device's lower portions.
Figure 22:
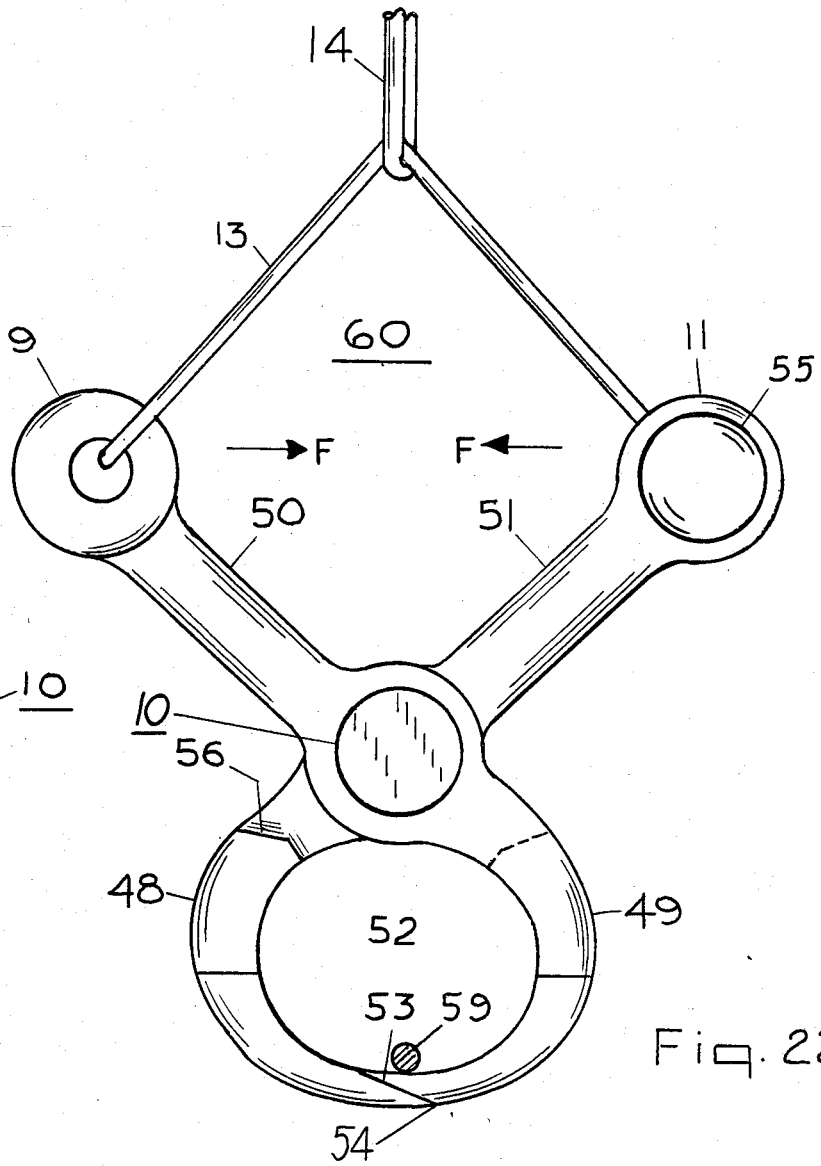
FIG. 22 is a front view of an assembled loading and unloading cable-scooping device, showing the location of suggested hoist cables, attached to holes in the upper portions of the device. The two pivoted flat elongated members have sharpened lower ends which come into contact and mate for the purpose of scooping up a load cable, attached to cargo to be suspended and transported.
Figure 24:
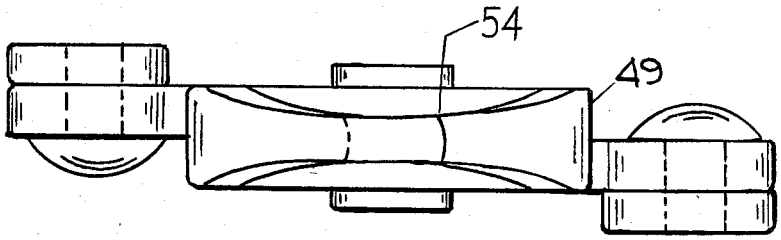
FIG. 24 is a bottom view thereof.

An embodiment of a shovel-like device 60 is portrayed in assembly drawings of FIGS. 22, 23 and 24. Hoist cables 13 and 14 are shown to indicate their locations relative to device 60, although the exact fittings used for device attachment would be decided by the user and are not considered part of this invention. Irregardless of the type of attachment, forces F, FIG. 22, should exist when device 60 is in suspension, as shown, causing its lower portions 48 and 49 to be mated with each other.

Device 60 has its lower portions shaped to enable their ends 53 and 53', FIGS. 25 and 28, respectively, to scoop up a load cable attached to the cargo, without the need for ground personnel to make the actual attachment of cable 59, shown in cross section, to device 60, FIG. 22.

Device 60 comprises two elongated, approximately flat members 50 and 51, pivoted near their mid-sections by pivot pin 10. The device's upper portions are weighted with metal rings 9 to ensure that its lower portions will automatically separate, as in FIG. 10A, when it is lowered and comes in contact with an object below.

Device 60's lower portions 48 and 49 are sharply curved toward each other and have sharpened knife-like ends 53 and 53', FIGS. 25 and 28, to enable them to scoop up the selected load cable, as device 60 is being lifted by cables 13 and 14. If the load cable is not scooped up on the first try, device 60 may be lowered again at the location of the load cable to be scooped up on the second try. It is easier for cable 59 to be scooped up when the cable is slightly off the supporting surface.

Like a pair of scissors, the device's upper portions are not as thick as its lower portions. The increased thickness occurs at line 56, FIGS. 22, 25 and 26.

Toward the end of each of lower portions 48 and 49, their widths, as shown in side view, FIG. 23, begin to taper until they end in the narrow width W. It is easier for a narrower width scoop or blade to pick up a cable than for a wider width, such as near the mid-sections of device 60, because the cable may not be stretched out perfectly straight and slightly off the supporting surface. Unfortunately, this narrower width W would make that portion of device 60 weaker and under greater stress. Therefore, lower portions 48 and 49 should have greater strength-capability per square inch of cross section.

To enable sharp ends 53 and 53' to more easily scoop up load cable 59, the surfaces of these lower ends may be greased after being polished. The procedure for picking up and depositing a cable attached to a load would be similar to that of previous embodiment descriptions; and the conditions to exist for a load cable to be discharged is described under embodiment No. 2.

Device 60 also is capable of scooping up cargo in drums, shaped like cavity 52, FIG. 22. It would be preferred that the drum size cross section be greater than the size of cavity 52. This would enable inside walls 48' and 49' of lower portions 48 and 49 to hug the drum's exterior cylindrical surface. The drum should be properly balanced within device 60 and prevented from sliding out of cavity 52, by roughing surfaces 48' and 49'.

Figure 32:
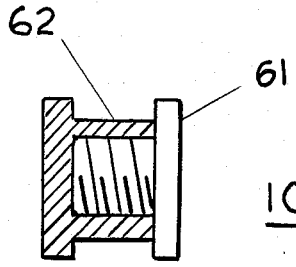
FIG. 32 is a sectional view thereof, along line 32—32.
Figure 31:
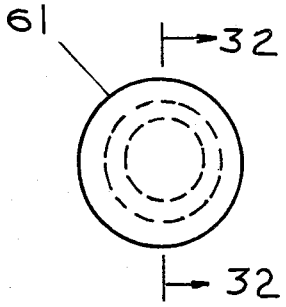
FIG. 31 is a front view of a pivot pin, shown in FIGS. 1, 1A, 10, 13 and 22.

Pin 10, FIG. 31, consists of an external threaded part 61, screwed into a part 62 with an internal thread, shown in sectional view FIG. 32, along line 32—32.

Figure 26:
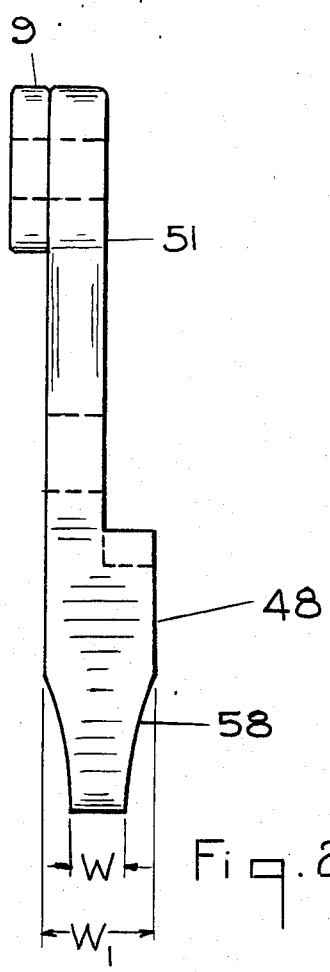
FIG. 26 is a side view thereof.
Figure 29:
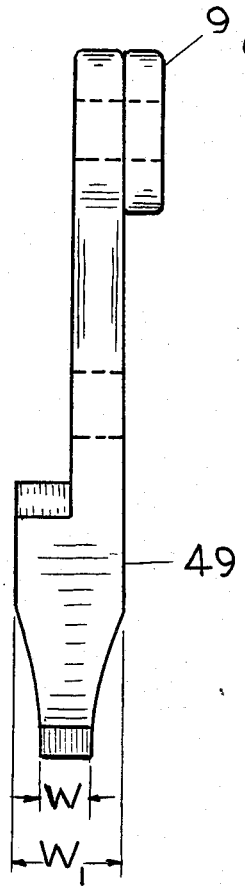
FIG. 29 is a side view thereof.
Figure 33:
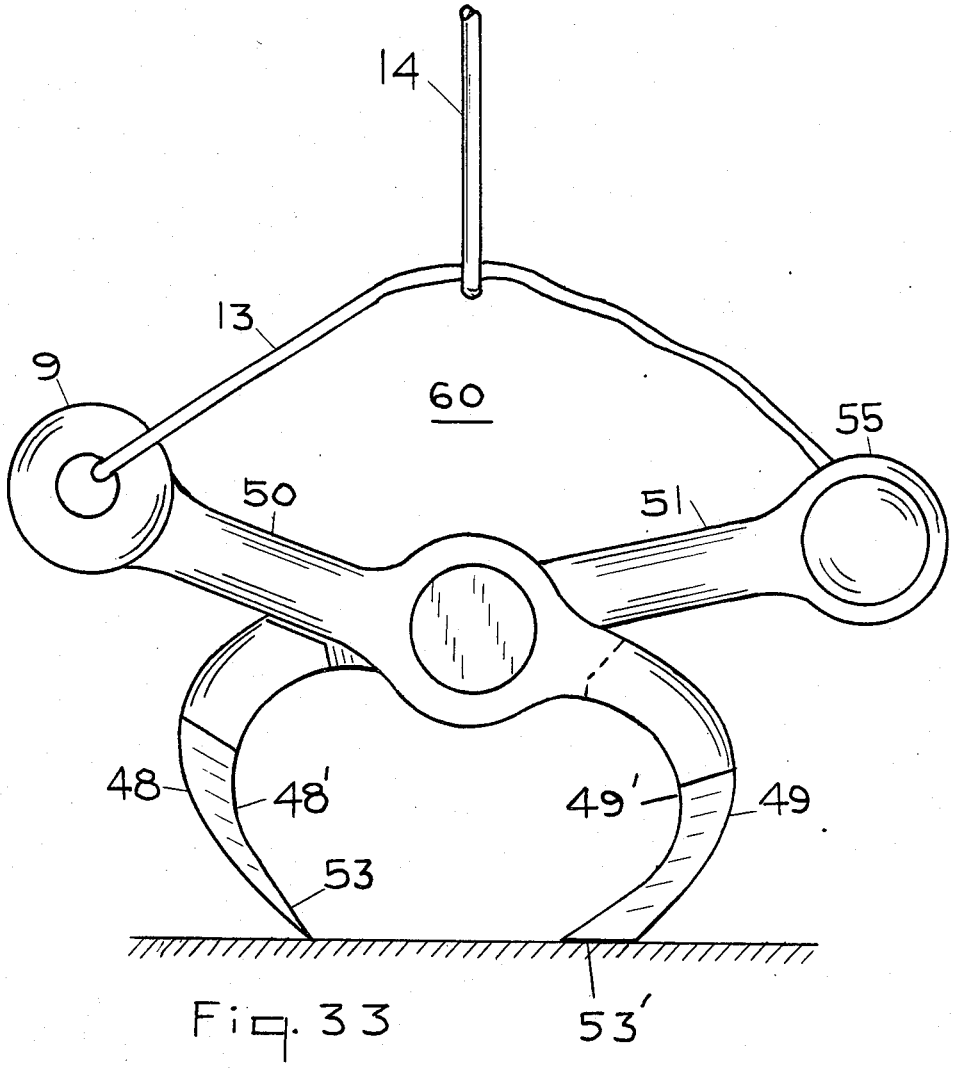
FIG. 33 is a front view of the cable-scooping device with its lower portions separated for discharging the load cable. Note that it is designed to stand upright.

In regard to the narrow width W in FIGS. 23, 26 and 29, it may be desirable for the widths of lower portions 48 and 49 to remain constant and be $W_1$, since then device 60 can stand upright, as shown in FIG. 33. Note that flat end 53', FIG. 33, is aligned with surface 41, and the tip of end 53 of portion 48 also is touching surface 41, enabling device 60 to stand upright. Ring members 9 may be added to both sides of upper portions 50 and 51, FIGS. 22, 26 and 29, in order to ensure sufficient weight in the upper portions.

Figure 35:
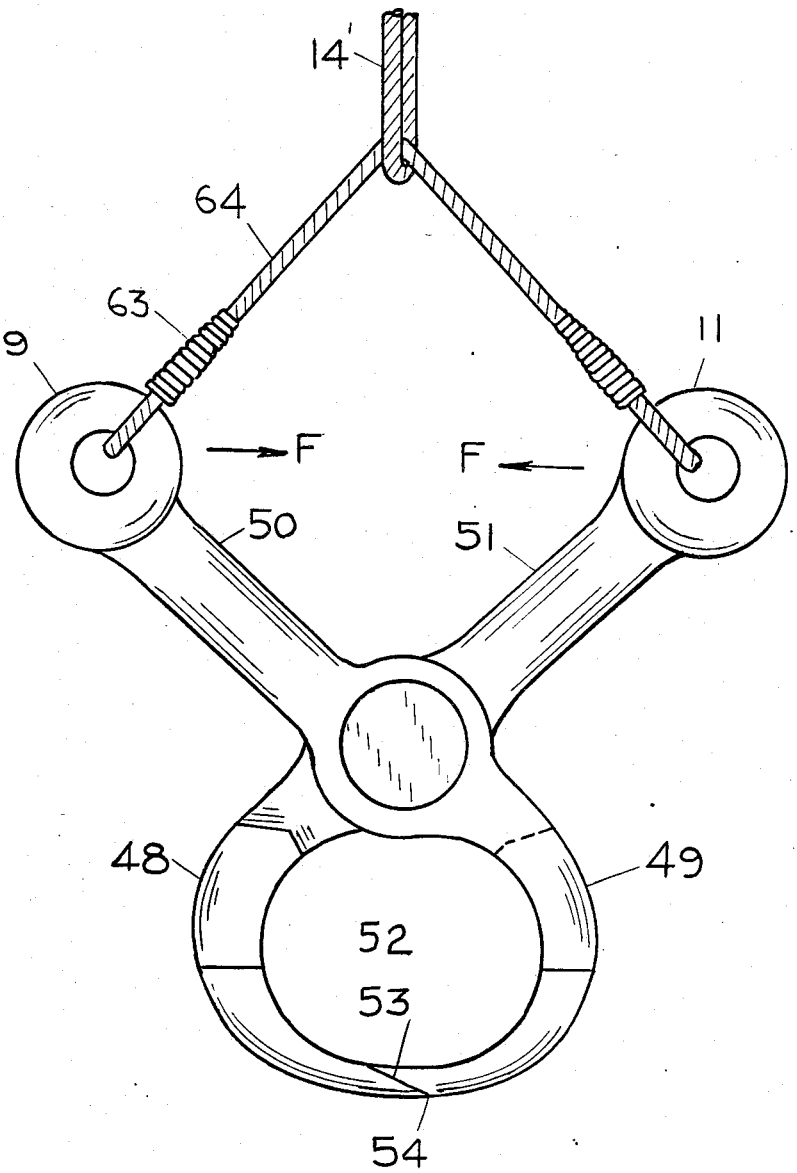
FIG. 35 is a front view of a load-cable-scooping device showing the side views of the hand-spliced eye and thimble fitting.
Figure 34:
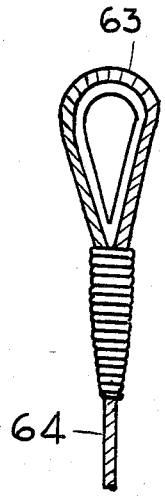
FIG. 34 is a front view of a hand-spliced eye and thimble fitting.

For a more symmetrical support of device 60, FIG. 22, by hoist cables, fittings to support upper portions 50 and 51 may be hand-spliced eye and thimble fittings 63, shown in FIG. 34. The eye and thimble fittings 63 are shown in place in the device's front view shown in FIG. 35. Fitting 63 is connected and fastened to hoist cable 64.

Fitting 63 is not considered a part of this invention. It is a commercially, off-the shelf, available item. Other such wire rope fittings which may be considered for this application are: spelter (zinced) socket, swedged socket, Crosby-type clips and thimble. The aforesaid fittings also will provide symmetrical support of device 60.

After load cable 59 has been deposited on a surface, then cable 59 may be either pulled away from device 60 or the device itself may be swung away from load cable 59, FIG. 22, before being hoisted, to avoid the cable from being snagged or scooped up by device 60 a second time.

Referring to the Preferred Embodiment, device 1', FIG. 1A, also can be used to retrieve matter from the bottom of a lake or ocean, even by relatively inexperienced persons in handling such devices, as no electrical signal is needed to operate the device. Its lower portions separate automatically when making contact with the water's bottom surface, and come together when the device is lifted. Device 30, FIG. 10, also may be used to retrieve matter from the bottom of a lake. As in device 1', when the device is lifted, its lower portions will automatically close, taking with them matter from the lake's bottom.

In order for the device to be better able to scoop up material from a pile, for example, device 30, FIG. 10, has been slightly modified to permit a rod to push the central portion of the device into the material, and not depend on the device's weight along to penetrate the loose material, which is to be loaded and transported.

Figure 37:
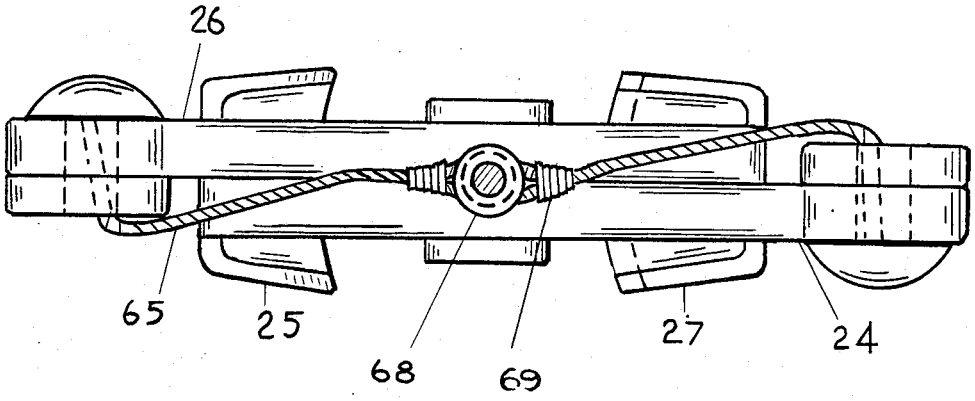
FIG. 37 is a top view thereof.
Figure 36:
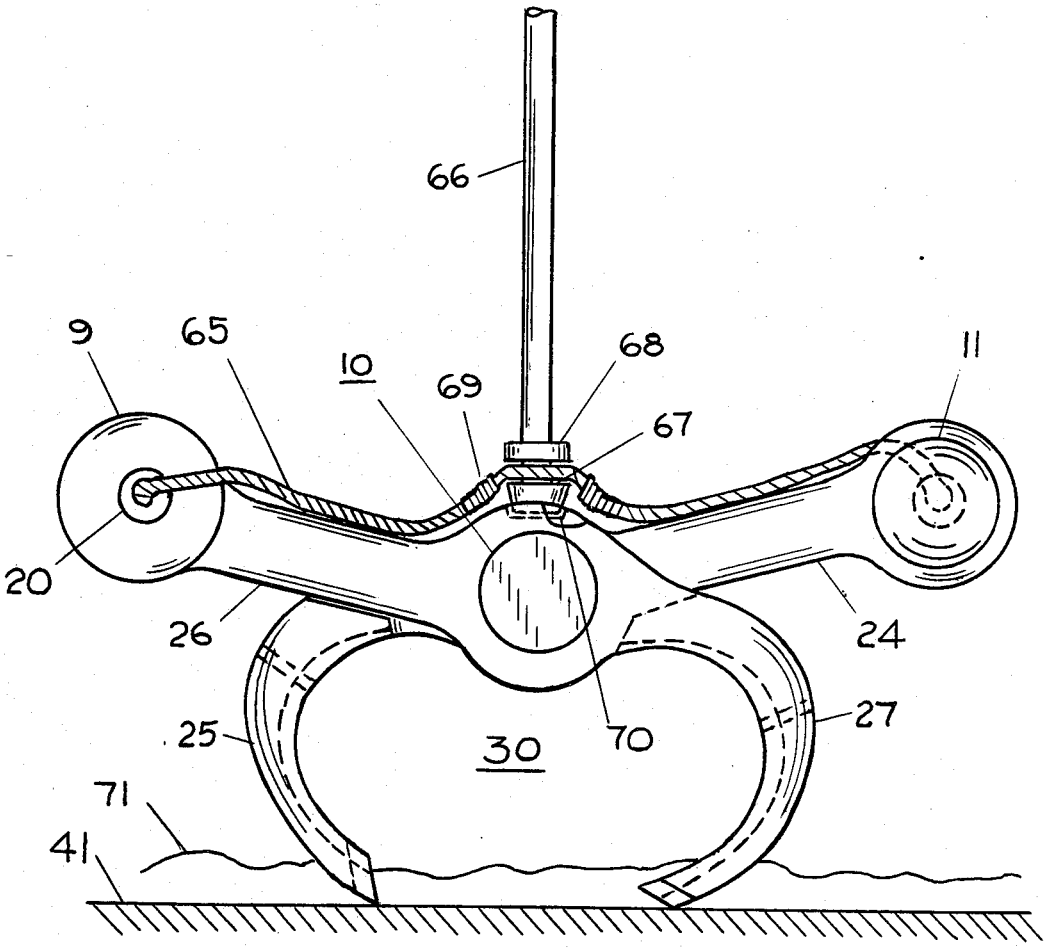
FIG. 36 is a front view of the shovel-like device with its lower portions separated, as shown in FIG. 10A, but with a vertical rod substituted for the vertical hoist cable.

FIG. 36 shows device 30, with recess 70 located at top center, to allow the bottom of rod 66 to sit into. Recess 70 is tapered and circular like the enlarged bottom portion 67 fixed to rod 66. Then, cable 65 is separated and divided at its center portion in order for it to straddle rod 66, as shown in FIGS. 36 and 37. Then, a ring 68 is positioned above the divided cable 65, to prevent the cable from climbing up the rod, although the ring 68 is not an essential item for the device's performance. To prevent cable 65 from unravelling much beyond rod 66, wire 69 is entwined or wrapped around the cable, as shown in FIGS. 36 and 37, leaving a sufficiently large hole in the cable for the cable to move freely around 66.

When rod 66 is pulled vertically up, to lift a load of material, cable 65 becomes taut and undergoes tensile stress. Thus, horizontal component forces F , FIG. 10, cause lower portions 25 and 27 to come together and engage, as shown in FIG. 10. Now the material scooped up by the device is ready to be transported elsewhere.

Another application for this device is in high school physics classrooms and laboratories where static and dynamic laws of physics can be demonstrated, using a model of this device for scooping up materials either off a desk surface or off the bottom of a pail of water. Device 30, FIG. 10, could be one embodiment that could be considered for fabrication for such demonstrations.

What is claimed is:

1. An automatic, tongs-like materials' scooping and unloading device, comprising a tong-like structure having two elongated members and having upper and lower portions, pivoted near their midsections with a pivot pin, for use with hoist cables being adapted for attachment to said upper portions of said structure, and a load cable, said upper portions having additional weights attached, said lower portions being sharply curved toward each other and having ends that are forced into contact with each other as a result of the tension on said hoist cables, to scoop up a load cable attached to a load to transport said load, said ends being sharp-edged and overlapping to facilitate the picking up of said cable; said ends having arcuate mating surfaces, one being concave and the other convex, said convex and concave surfaces being adapted to mate with each other, said surfaces having the same radius of curvature, so that said concave and convex surfaces enable said lower portions to share the stresses being imposed on said pivot pin, said stresses being caused by the lateral swinging motions of said scooping device under load-suspended, wind-gust conditions, whereby said lower portions will separate automatically when said tension in said hoist cables is significantly reduced, thus enabling said load to be discharged; said tension on said hoist cables being caused by said additional weights placed on the upper portions of said elongated members.

2. A tongs-like lifting device for automatic loading and unloading of materials, comprising a structure having two elongated members and having upper and lower portions, said portions pivoted near their midsections with a pivot pin, for use with hoist cables being adapted for attachment to said upper portions of said structure, said upper portions having additional weights and less width than said lower portions, said lower portions being sharply curved toward each other and having ends that are forced into contact with each other as a result of the tension on said hoist cables, to scoop up and transport said materials, said lower portions having concave, bowl-shaped recesses, said ends being sharp-edged, overlapping and one of said ends pointing downward to facilitate scooping up of said materials and holding and retaining said materials; whereby said lower portions will separate automatically when said tension in said hoist cables is significantly reduced, thus enabling said materials to be discharged automatically; said tension on said hoist cables being caused by said additional weights fastened to said upper portions of said elongated members.

3. A tong-like, materials digging and scooping device, comprising a tongs-like structure having two elongated members with upper and lower portions, pivoted near their mid-sections with a pivot pin for use with a flexible hoist cable being adapted for attachment to said upper portions, said upper portions having additional weights, wherein said device has an upper central area and includes a vertical rod having an enlarged bottom end, and wherein each of said upper portions has a hole near its end and said flexible cable with a slightly oblong hole at its middle being connected from one said hole to the other said hole, said rod passing through said oblong hole, said enlarged bottom end preventing said rod from slipping through said oblong hole; said lower portions being sharply curved toward each other and having ends that are forced into contact with each other as a result of the tension on said flexible cable, for scooping up said materials, said lower portions being bowl-shaped, said ends being sharp-edged and overlapping to facilitate picking up said materials and holding and retaining them; whereby said device can scoop up more of said materials from a loading area when said rod is used to push down on said upper central area of said device to cause said ends of said lower portions to dig into and gather more of said materials when said rod again is lifted and said ends of said lower portions are forced into contact with each other; said tension on said flexible cable being caused by said additional weights on said upper portions of said elongated members.

4. A device in accordance with claim 3, and wherein said ends of said lower portions having sharp, triangular teeth said triangular teeth mating with each other, to enable said ends to perform a digging operation into relatively soft ground.

* * * * *